US006964243B1

(12) United States Patent
Thompson

(10) Patent No.: US 6,964,243 B1
(45) Date of Patent: Nov. 15, 2005

(54) KAYAK ACCESSORY PACK

(76) Inventor: Jeffrey Thompson, P.O. Box 127, Marshfield Hills, MA (US) 02051

( * ) Notice: Subject to any disclaimer, the term of this patent is extended or adjusted under 35 U.S.C. 154(b) by 0 days.

(21) Appl. No.: 10/897,604

(22) Filed: Jul. 23, 2004

(51) Int. Cl.[7] ..... B63B 35/00
(52) U.S. Cl. ..... 114/347
(58) Field of Search ..... 114/343, 347, 364

(56) References Cited

U.S. PATENT DOCUMENTS 1,846,039 A * 2/1932 Pratt et al. ..... 217/128
2,690,799 A * 10/1954 Gerstenmaier ..... 160/231.2
3,958,289 A 5/1976 Carlson
4,398,488 A 8/1983 Mathieu
4,569,301 A 2/1986 Pyburn
4,739,720 A 4/1988 Jarschke
5,243,928 A 9/1993 Brenaman
5,257,590 A 11/1993 Foote, Jr. et al.
5,279,248 A 1/1994 Blachford
5,511,507 A 4/1996 Allen
5,542,369 A 8/1996 Ingram
5,605,112 A 2/1997 Schuman
5,671,694 A 9/1997 Schoettle
5,996,527 A 12/1999 Ambrozic
6,050,213 A 4/2000 Stevens
2004/0079273 A1 * 4/2004 Godek ..... 114/347

* cited by examiner

*Primary Examiner*—Stephen Avila
(74) *Attorney, Agent, or Firm*—John P. McGonagle

(57) ABSTRACT

A water-tight, streamlined storage pack, removably attached to a kayak deck and accessible by a kayak operator during kayak operation. The present invention pack also provides lighting and fishing rod holders.

10 Claims, 6 Drawing Sheets

KAYAK ACCESSORY PACK

BACKGROUND OF THE INVENTION

This invention relates to kayaks, and in particular, to an accessory pack attached to the kayak deck in front of the kayak cockpit.

Kayaks have become increasingly popular as a method of marine transportation. A kayak is faster and more maneuverable than either a canoe or a rowboat and is not as restricted in use as a sailboat or a motorboat. During kayak operation, it is desirable for the kayak operator to bring with him or her various items such as drinking water, maps, food, fishing rods and fishing accessories, camping gear and other supplies. Items such as maps, cameras, GPS units, cellphones and walkmans, must also be kept dry.

On its own, the kayak does not have readily available internal storage space. What little internal storage space a kayak has is inaccessible during operation. Normal and safe operation of a kayak designed for sea or river operation involves the use of a device known as a spray skirt. The spray skirt, worn around the waist of the kayak operator and physically connected to the cockpit of the kayak, prevents water or spray from entering the cockpit opening. When the spray skirt is employed, the opening is thereby sealed. Any items inside the kayak are inaccessible.

The prior art has on occasion used dry wells formed in the rear deck of a kayak to provide externally accessible dry storage. However, the wells are generally positioned to the rear of the kayak operator and are inaccessible during kayak operation. The prior art has also provided deck rigging comprised of elastic bungee cords crisscrossed to deck loops on the front and/or rear decks of the kayak. A waterproof bag may then be tucked beneath the bungee cords. Accessibility during kayak operation, while difficult, is not impossible. However, the waterproof bags have a tendency to slip around under the cords. The irregular shape of the bags also affects the flow of air and water over the kayak deck increasing the difficulty of maneuvering the kayak.

SUMMARY OF THE INVENTION

In view of the foregoing disadvantages inherent in the known types of devices now present in the prior art, the present invention provides a water-tight, streamlined storage pack, removably attached to a kayak deck and accessible by a kayak operator during kayak operation. The present invention pack also provides lighting and fishing rod holders.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
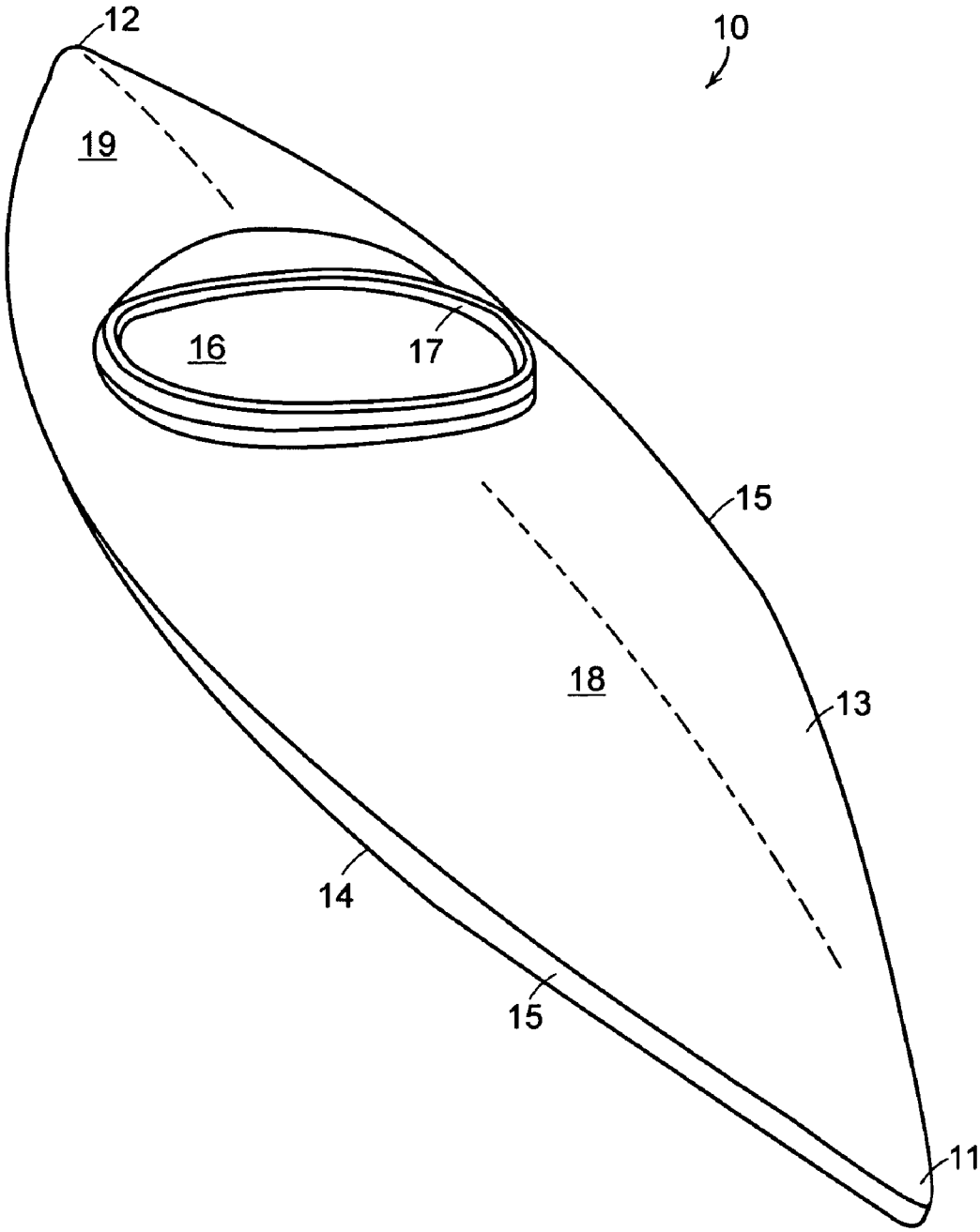
FIG. 1 is a front perspective view of a kayak.
Figure 2:
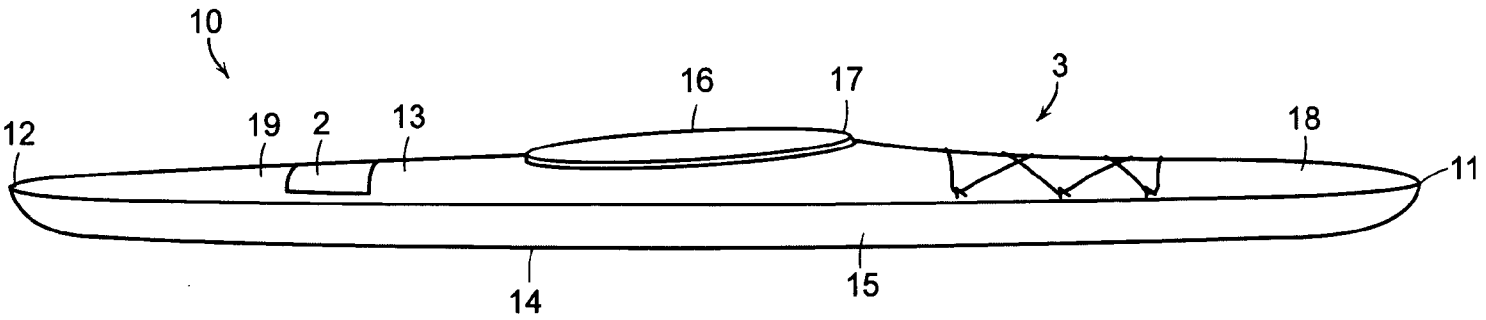
FIG. 2 is a side view of a kayak showing prior art storage areas.
Figure 3:
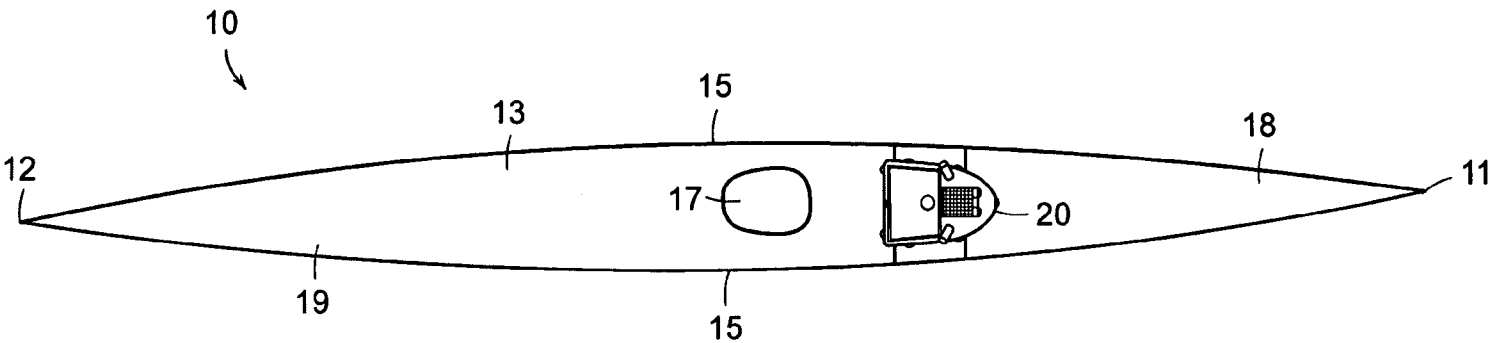
FIG. 3 is a top view of a kayak showing an invention accessory pack attached thereto.
Figure 4:
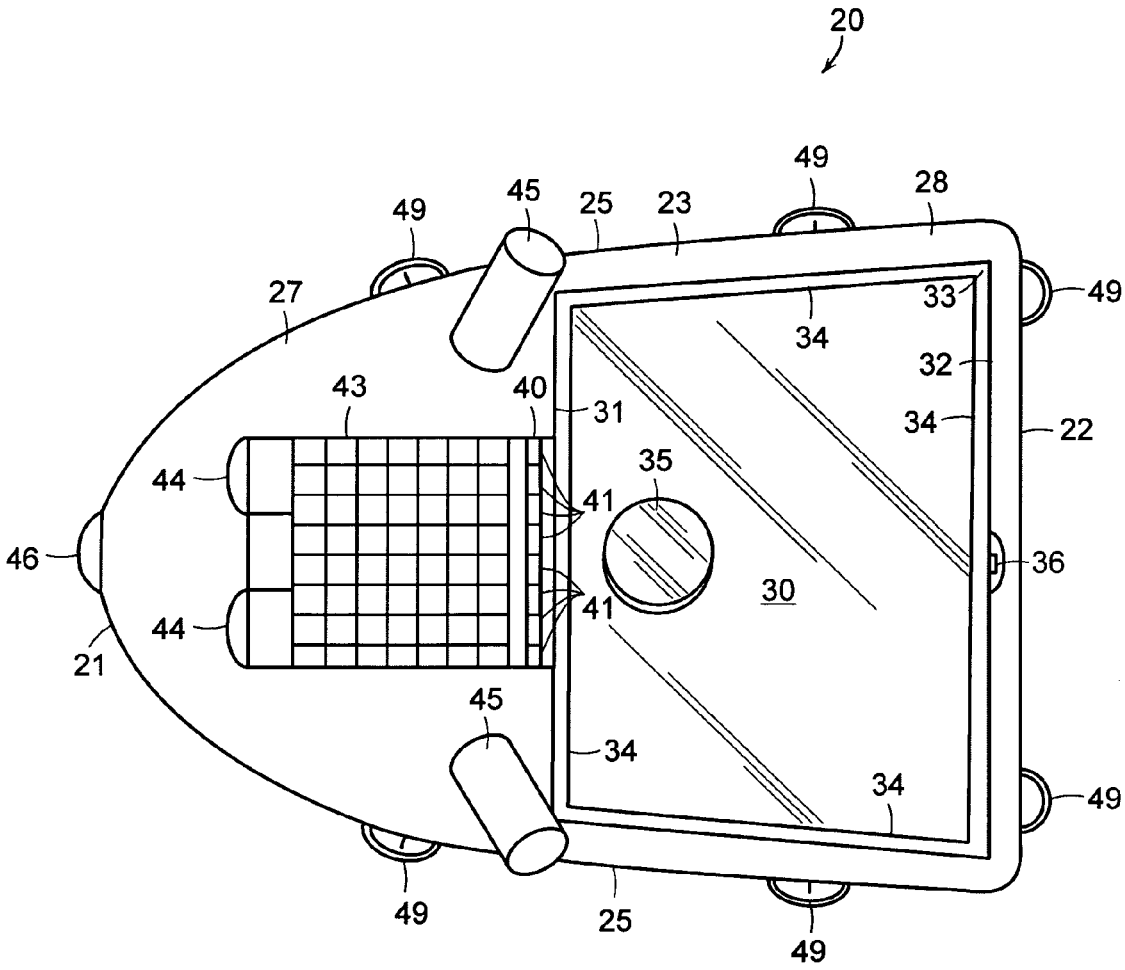
FIG. 4 is a top view of the invention accessory pack.
Figure 5:
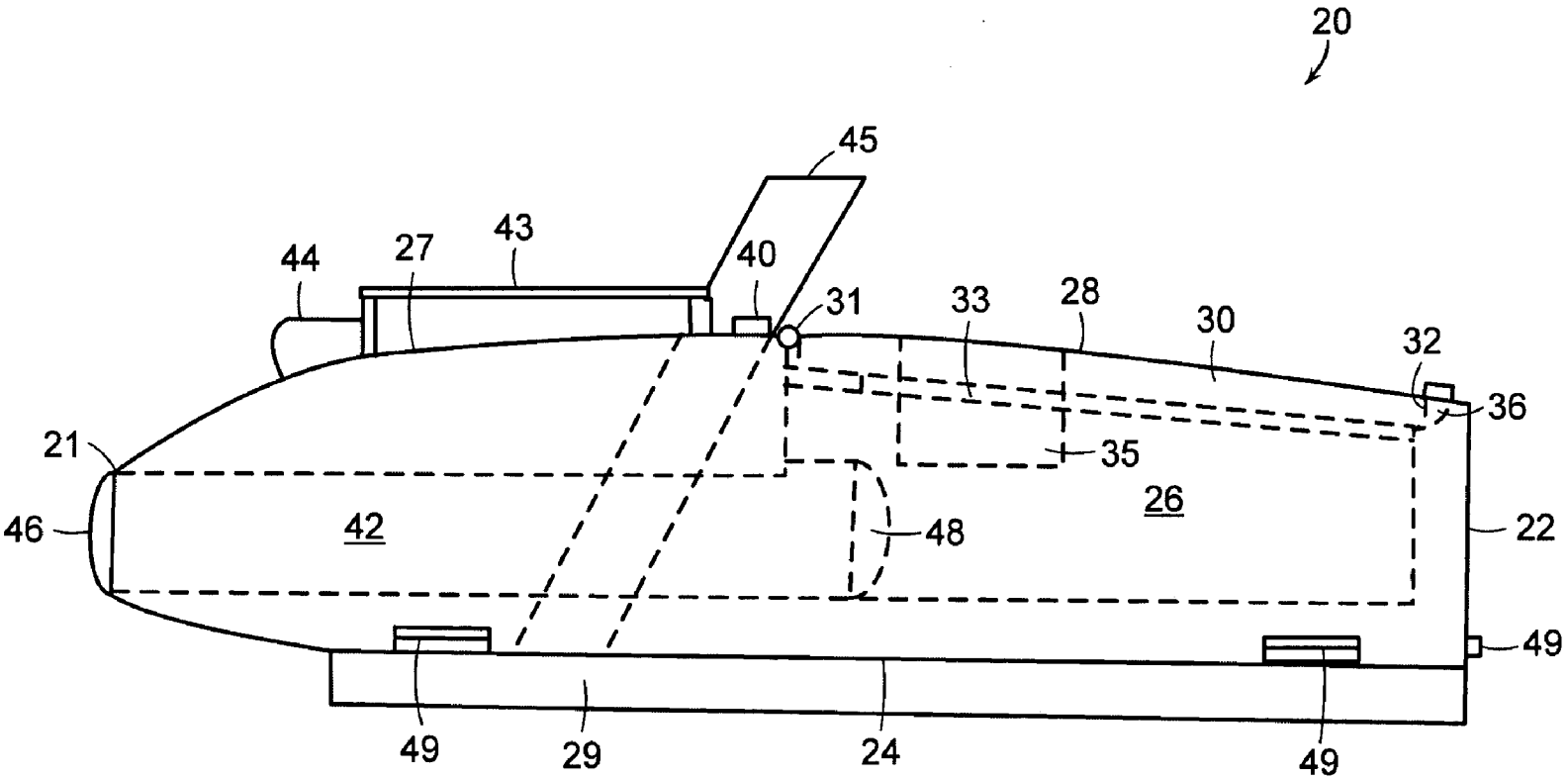
FIG. 5 is a side view, partly in section, of the accessory pack of FIG. 4.
Figure 6:
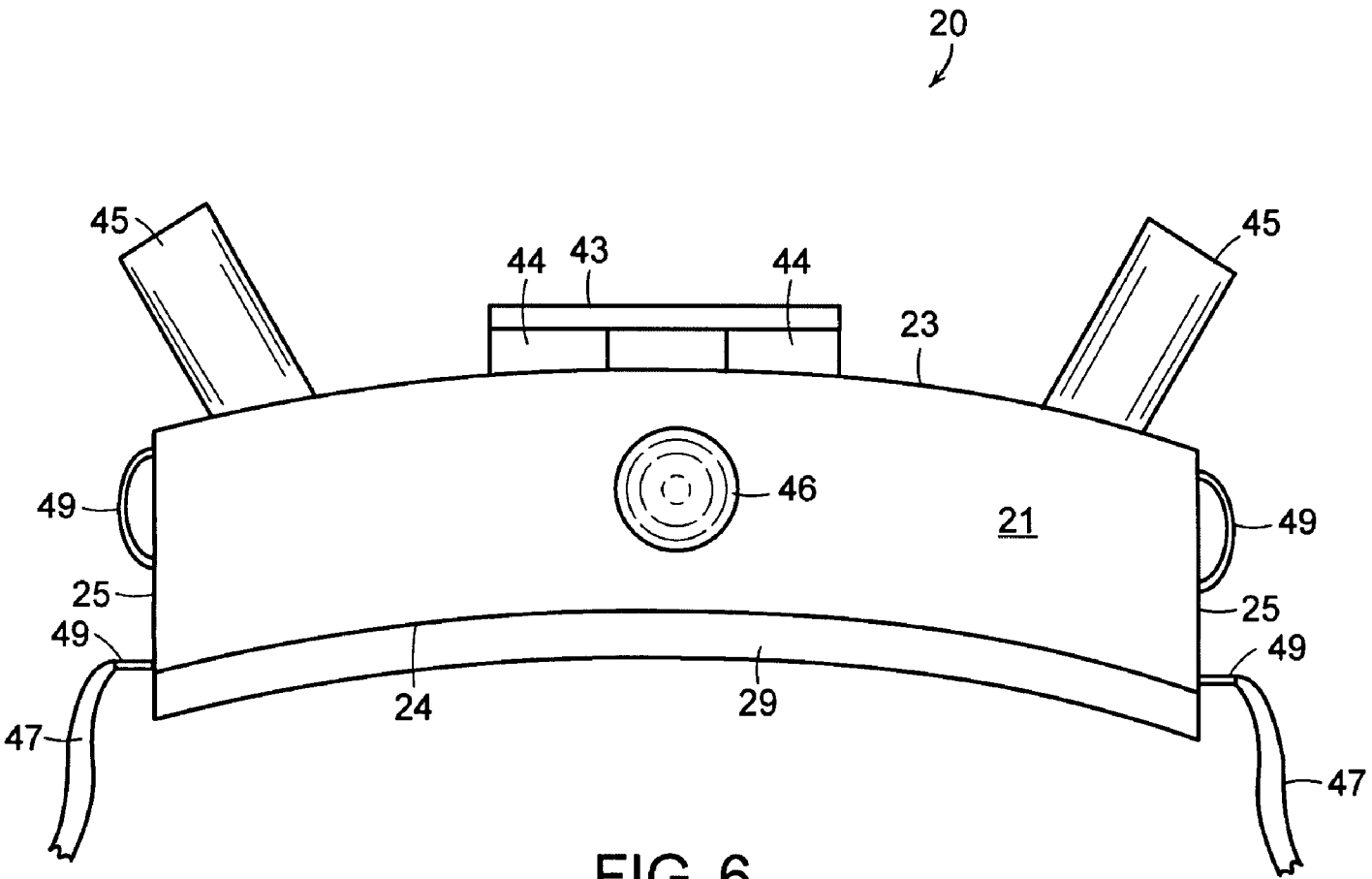
FIG. 6 is a front view of the accessory pack of FIG. 4.
Figure 7:
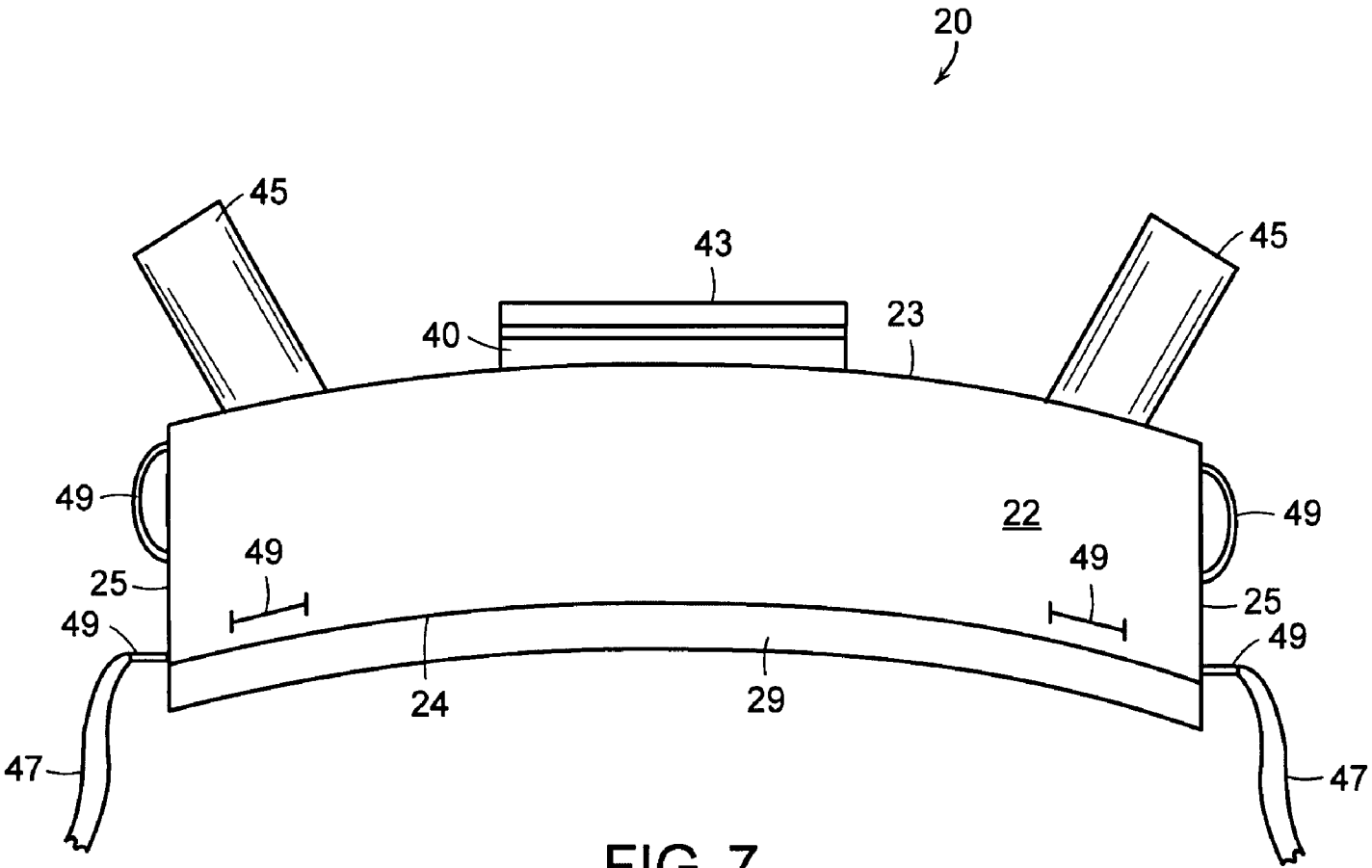
FIG. 7 is a rear view of the accessory pack of FIG. 4.

Referring to the drawings in detail wherein like elements are indicated by like numerals, there is shown in FIG. 1 a general depiction of a standard kayak 10. The kayak 10 has a hull with a front (bow) 11, a rear (stern) 12, a top 13, a bottom 14 and two sides 15. The kayak front 11, rear 12, top 13, bottom 14 and sides 15 define a hollow interior 16. The kayak top 13 has at least one cockpit 17 opening through the kayak top 13 into the kayak hollow interior 16. The kayak top 13 may be further defined as having a forward deck 18 between the cockpit 17 and the bow 11, and as having a rearward deck 19 between the cockpit and the stern 12. FIG. 2 illustrates a kayak with prior storage areas. A dry well 2 is formed through the kayak rearward deck 19. The kayak forward deck 18 has deck rigging 3 comprised of crisscrossed elastic bungee cords. FIG. 3 illustrates an kayak accessory pack 20 constructed according to the principles of the present invention attached to a kayak forward deck 18.

Referring to the drawings, especially FIGS. 4 through 7, there is illustrated an accessory pack 20 of the present invention generally adapted to being removably attached to the kayak forward deck 18. The accessory pack 20 has a front 21, a rear 22, a top 23, a bottom 24 and two sides 25. The accessory pack front 21, rear 22, top 23, bottom 24 and sides 25 define a hollow interior 26. The accessory pack front 21 is that portion of the accessory pack nearest the kayak bow 11. The accessory pack rear 22 is that portion of the accessory pack nearest the kayak cockpit 17. The accessory pack top 23 may be divided into a forward portion 27 and a rearward portion 28.

The top rearward portion 28 is comprised generally and substantially of a transparent lid 30 hinged along an approximate dividing line 31 between the top forward portion 27 and top rearward portion 28. A latch 36 releasably joins the lid rearward edge 32 to the accessory pack top 23 near to the accessory pack rear 22. A water tight seal 33 is attached to the lid 30 about the lid's perimeter 34. The lid 30 has a recessed, round well 35 formed centrally therein near to the hinge line 31, said well 35 adapted especially to hold a cup or bottle. The lid 30 is adapted to provide access to the accessory pack interior 26 by a kayak operator positioned in the kayak cockpit 17.

The pack top forward portion 28 has an electric switch strip 40 mounted thereon, near to and parallel to the dividing line 31, said strip containing a plurality of electric switches 41 adapted to control electric power from a battery 42 within the accessory pack interior 26. The battery 42 is located within the accessory pack interior adjacent the accessory pack front 21. A light 48 is attached to the pack interior 26, said interior light 48 being electrically interconnected via a specific switch 41 to the battery 42. Immediately forward of the strip 40 is a generally rectangular, flat peg board 43 fixedly attached to the pack top 23. Immediately forward of the peg board 43, two parallel, side-by-side, running lights 44 are attached to the pack top 23, said lights 44 being electrically interconnected via specific switches 41 to the battery 42. The top forward portion 27 also has two, angled, generally cylindrical, fishing rod holders 45, each holder 45 protruding from the pack interior 26, through the pack top 23 on each side of the peg board 43.

The accessory pack 20 has a main light 46 centrally and adjustably attached to said accessory pack front 21 and electrically interconnected via a specific switch 41 to the battery 42. A number of D-rings 49 are mounted about the accessory pack sides 25 and rear 22, several of which are adapted to provide attachment of tie down, nylon web straps 47 about the kayak hull, thereby securing the accessory pack 20 to the kayak forward deck 18. The D-rings 49 also provide means to remove the accessory pack 20 from the kayak 10 and use the accessory pack 20 as a backpack for portage.

The accessory pack bottom 24 may be laterally curved to better fit against the kayak forward deck 18. It is also desirable to have a section of soft foam 29 attached to the accessory pack bottom 24. The foam 29 provides an even better fit of the pack 20 against the forward deck 18 and prevents marring of the deck finish.

It is understood that the above-described embodiment is merely illustrative of the application. Other embodiments may be readily devised by those skilled in the art which will embody the principles of the invention and fall within the spirit and scope thereof.

I claim:

1. An accessory pack used in conjunction with a kayak, said kayak having a hull with a front bow, a rear stern, a top, a bottom and two sides, said kayak bow, stern, top, bottom and sides defining a hollow kayak interior, said kayak top having a cockpit opening through the kayak top into the kayak hollow interior, said kayak top having a forward deck between the cockpit and the bow, said accessory pack removably attached to said kayak deck and accessible by a kayak operator from said cockpit during kayak operation, comprising:

a housing having a front, a rear, a top divided into a forward portion and a rearward portion, a bottom, and two opposite sides, said front, rear, top, bottom and sides defining a hollow interior, said front being that part of the housing nearest the kayak bow and said rear being that part of the housing nearest the kayak cockpit;

a lid in said top rearward portion hinged along an approximate dividing line between the top forward portion and top rearward portion;

a water tight seal attached to the lid about a lid perimeter;

a latch releasably joining a lid rearward edge to the housing top near to the housing rear;

a plurality of rings attached to the housing sides and rear, several of which being adapted to provide attachment of a plurality of straps about the kayak hull, thereby securing the accessory pack to the kayak forward deck, and several of which adapted to provide attachment of a plurality of straps for use of the accessory pack as a backpack for portage;

an electric switch strip mounted on the housing top forward portion near to and parallel to the dividing line, said strip containing a plurality of electric switches adapted to control electric power from a battery positioned within the accessory pack interior.

2. An accessory pack as recited in claim 1, further comprising:

an interior light attached within the housing interior, said interior light being electrically interconnected via a designated electric switch to the battery.

3. An accessory pack as recited in claim 2, further comprising:

a main light centrally and adjustably attached to said housing front and electrically interconnected via a designated electric switch to the battery.

4. An accessory pack as recited in claim 3, wherein:

the housing bottom is laterally curved.

5. An accessory pack as recited in claim 4, further comprising:

a section of soft foam attached to the housing bottom.

6. An accessory pack as recited in claim 5, wherein:

the lid is transparent.

7. An accessory pack as recited in claim 6, further comprising:

a generally rectangular board fixedly attached to said housing top forward of the electric switch strip.

8. An accessory pack as recited in claim 7, further comprising:

a recessed, round well formed centrally in said lid near to the dividing line, said well adapted to hold a cup or bottle.

9. An accessory pack as recited in claim 8, further comprising:

two parallel, running lights attached to the housing top forward of the board, said running lights being electrically interconnected via designated electric switches to the battery.

10. An accessory pack as recited in claim 9, further comprising:

two, angled, generally cylindrical, fishing rod holders, formed in said housing top forward portion, each said holder protruding from the housing interior, through the housing top on each side of the board.

* * * * *